US012428253B2

(12) United States Patent
Miyakoshi et al.

(10) Patent No.: US 12,428,253 B2
(45) Date of Patent: Sep. 30, 2025

(54) MEDIUM CONVEYING DEVICE AND IMAGE FORMING APPARATUS

(71) Applicant: KYOCERA Document Solutions Inc., Osaka (JP)

(72) Inventors: Naoto Miyakoshi, Osaka (JP); Shuji Osaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 223 days.

(21) Appl. No.: 18/359,623

(22) Filed: Jul. 26, 2023

(65) Prior Publication Data

US 2024/0034588 A1 Feb. 1, 2024

(30) Foreign Application Priority Data

Jul. 29, 2022 (JP) ..... 2022-121497

(51) Int. Cl.
*B65H 29/12* (2006.01)

(52) U.S. Cl.
CPC . *B65H 29/125* (2013.01); *B65H 2404/13161* (2013.01); *B65H 2404/1341* (2013.01); *B65H 2404/1416* (2013.01); *B65H 2404/1431* (2013.01); *B65H 2404/144* (2013.01); *B65H 2801/06* (2013.01)

(58) Field of Classification Search
CPC .... B65H 2404/1416; B65H 2404/1521; B65H 2404/1372; B65H 2404/144; B65H 29/125; B65H 29/12
See application file for complete search history.

(56) References Cited

U.S. PATENT DOCUMENTS 5,606,357 A * 2/1997 Bekki ..... B41J 13/076 271/274
5,961,234 A 10/1999 Uchikata
7,955,013 B2 * 6/2011 Ortiz ..... B65H 29/12 400/636
8,905,537 B2 * 12/2014 Lo ..... B65H 5/062 347/104
9,394,132 B2 * 7/2016 Kobayashi ..... B65H 29/14

FOREIGN PATENT DOCUMENTS

JP H10-167507 A 6/1998

* cited by examiner

*Primary Examiner* — Patrick Cicchino
(74) *Attorney, Agent, or Firm* — Studebaker Brackett PLLC

(57) ABSTRACT

A medium conveying apparatus includes a driving roller, a plurality of driven rollers, a support part, a plurality of upstream restriction parts and a plurality of downstream restriction parts. The support part supports the driven rollers. The upstream restriction parts are provided in the support part between the adjacent driven rollers. The downstream restriction parts are provided in the support part between the adjacent driven rollers. The upstream restriction parts and the downstream restriction parts are arranged on an upstream side and a downstream side in a conveyance direction of the medium across a rotational center of the driven rollers respectively. When the driven rollers are tilted with respect to the conveyance direction, at least one of the upstream restriction parts and the downstream restriction parts comes into contact with side surfaces of the driven rollers to restrict tilting of the driven rollers.

6 Claims, 5 Drawing Sheets

MEDIUM CONVEYING DEVICE AND IMAGE FORMING APPARATUS

INCORPORATION BY REFERENCE

This application is based on and claims the benefit of priority from Japanese patent application No. 2022-121497 filed on Jul. 29, 2022, which is incorporated by reference in its entirety.

BACKGROUND

The present disclosure relates to a medium conveying device which conveys a medium and an image forming apparatus.

A conveying device is known which conveys a sheet while holding it between a discharge roller made of high-rigidity material and multiple spur rollers. The discharge roller has a discharge roller part coming into contact with the sheet and a roller groove part provided at positions facing the spur rollers, and the surface of the discharge roller part is processed to increase friction force.

In the conveying device described above, the spur roller sometimes receives a reaction force from the sheet (medium) being conveyed, resulting in a posture inclined with respect to the proper conveyance direction. In this case, the sheet would be conveyed obliquely along the inclination of the spur roller, and the sheet would sometimes jam in the conveyance path. In addition, when the obliquely conveyed sheets will be discharged on the discharge tray, various failure may occur, for example, the sheet could not be stacked in an aligned state.

SUMMARY

A medium conveying apparatus according to the present disclosure includes a driving roller, a plurality of driven rollers, a support part, a plurality of upstream restriction parts and a plurality of downstream restriction parts. The driving roller is driven to be rotated around an axis. The driven rollers are provided at intervals, and driven by the driving roller to be rotated around an axis and to convey a medium held between the driving roller and the driven rollers. The support part supports the driven rollers so as to be rotatable around the axis. The upstream restriction parts are provided in the support part between the adjacent driven rollers. The downstream restriction parts are provided in the support part between the adjacent driven rollers. The upstream restriction parts and the downstream restriction parts are arranged on an upstream side and a downstream side in a conveyance direction of the medium across a rotational center of the driven rollers respectively. When the driven rollers are tilted with respect to the conveyance direction, the upstream restriction parts and the downstream restriction parts comes into contact with side surfaces of the driven rollers to restrict tilting of the driven rollers.

An image forming apparatus according to the present disclosure includes the medium conveying apparatus.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
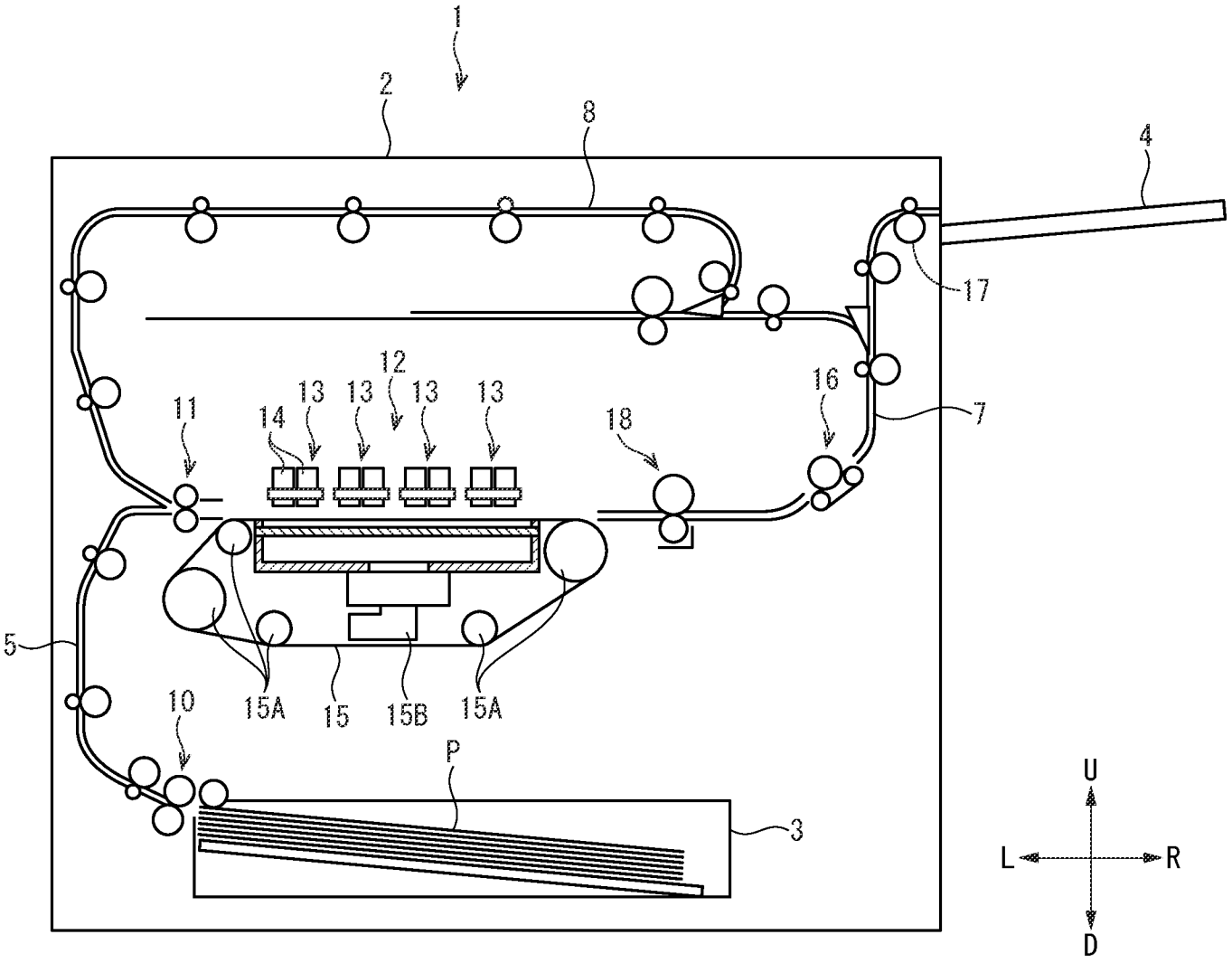
FIG. 1 is a front view showing an inner structure of a medium conveying device according to one embodiment of the present disclosure.

Hereafter, with reference to the attached drawings, an embodiment of the present disclosure will be described with reference to the drawings. Fr, Rr, L, R, U, and D in the drawings refer to the front, rear, left, right, upper and lower. The terms indicating the direction and position are used herein for illustrative convenience and are not intended to limit the technical scope of the disclosure.

[Image forming apparatus] With reference to FIG. 1, the image forming apparatus 1 will be described. FIG. 1 is a schematic view (front view) showing the inner structure of the image forming apparatus 1.

The image forming apparatus 1 is an inkjet printer which ejects ink droplet to forms an image on a sheet P (paper). The image forming apparatus 1 includes a box-shaped housing 2 in which various devices are housed. In the lower portion in the housing 2, a sheet feeding cassette 3 in which the sheets P are set is housed, and a sheet discharge tray 4 on which the printed sheet S is stacked is provided on the upper portion of the right side surface of the housing 2. In this specification, the direction in which the sheet P as an example of a medium is conveyed is referred to as the "conveyance direction", and the "upstream", "downstream" and similar terms refer to the "upstream", "downstream" and similar concept in the conveyance direction. The medium is not limited to the sheet P, but may be, for example, a sheet (film) made of resin.

In the left side portion in the housing 2, a first conveyance path 5 is formed, along which the sheet P is conveyed from the sheet feeding cassette 3 toward a head unit 12. A sheet feeding part 10 is provided at the upstream end of the first conveyance path 5, and a registration roller 11 is provided at the downstream end of the first conveyance path 5.

The head unit 12 has four line heads 13 corresponding to four inks of black, cyan, magenta and yellow. A plurality of recording heads 14 are mounted on each line head 13. The ink is supplied to each recording head 14 from each color ink pack (not shown) via a tube (not shown). Below the head unit 12, a conveyance belt 15 wound around a plurality of tensioning rollers 15A is provided. A large number of through-holes (not shown) are formed in the conveyance belt 15, and a suction part 15B for sucking air through the through-holes is provided inside the conveyance belt 15.

In the right side portion in the housing 2, a second conveyance path 7 is formed, along which the sheet P is conveyed from the head unit 12 toward the sheet discharge tray 4. A medium conveying device 18 is provided on the upstream side of the second conveyance path 7, a decurl device 16 is provided at the midstream of the second conveyance path 7, and a sheet discharge part 17 is provided at the downstream end of the second conveyance path 7. In the upper portion in the housing 2, a third conveyance path 8 is formed, along which the sheet P is reconveyed from the middle of the second conveyance path 7 to the registration roller 11.

[Image Forming Processing] An image forming processing will be described here. A control part (not shown) of the image forming apparatus 1 controls the various controlled devices as appropriate and executes the image forming processing as follows.

The sheet feeding part 10 feeds the sheet P picked up from the sheet feeding cassette 3 to the first conveyance path 5. The registration roller 11 temporarily blocks the sheet P and corrects the skew of the sheet P, and feeds the sheet P to the conveyance belt 15 in accordance with the ejection timing of ink droplets from the line head 13. The sheet P is conveyed while being attracted to the conveyance belt 15, and each recording head 14 mounted on the head unit 12 ejects the ink droplets from the nozzles (not shown) toward the sheet P on the conveyance belt 15 to form a full-color image. The medium conveying device 18 (a conveyance rollers pair 20) conveys the printed sheet P downstream in the conveyance direction, and the decurl device 16 corrects the curl of the sheet P.

The one-side printed sheet S is discharged to the sheet discharge tray 4 through the second conveyance path 7. When performing a double-sided printing, the one-side printed sheet P is conveyed to the third conveyance path 8, is inverted upside down and then conveyed again toward the registration roller 11. Then, an image is formed on the back side of the sheet P in the same order as in the one-side printing described above, and the both-side printed sheet P is discharged on the discharge tray 4.

Figure 2:
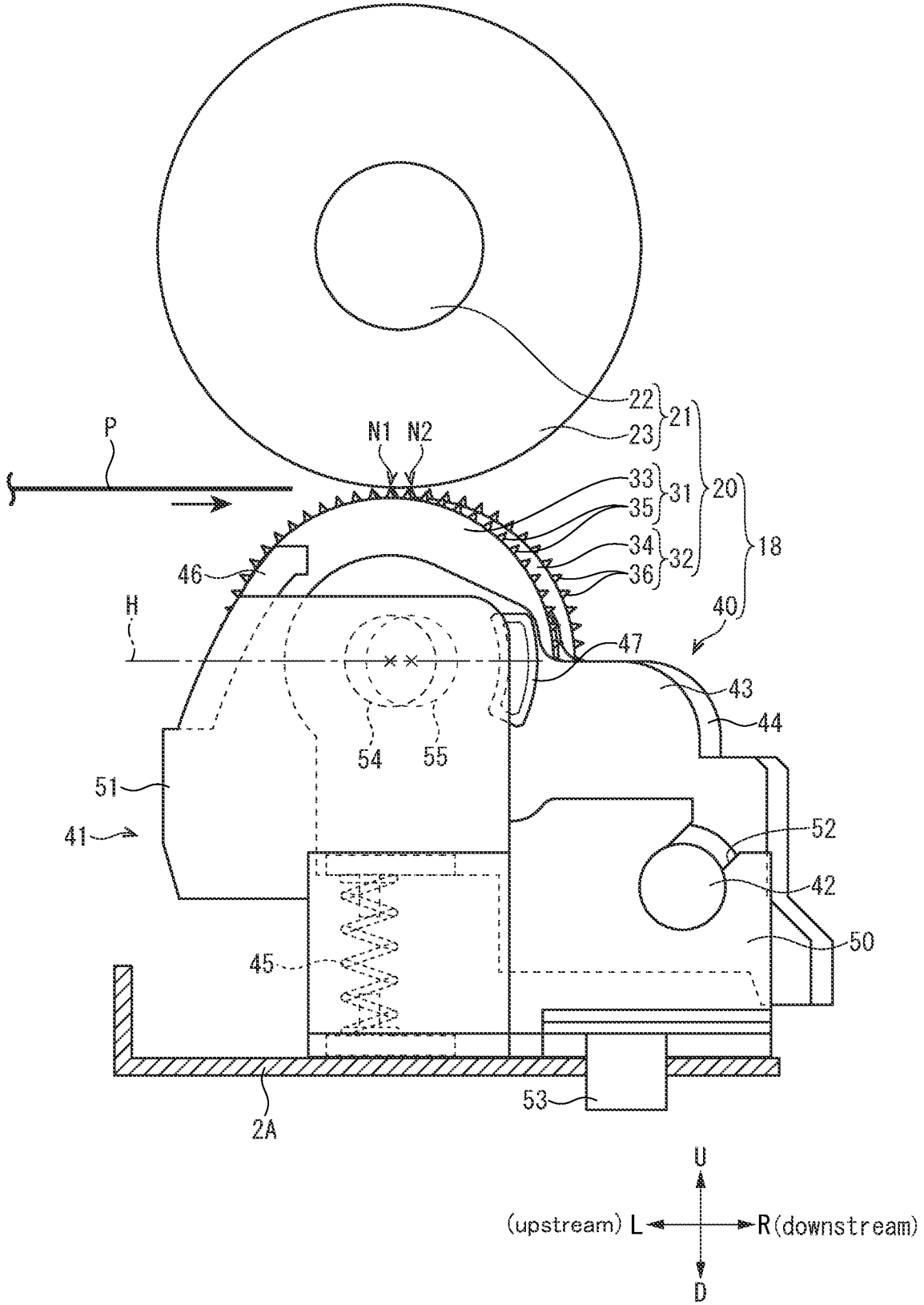
FIG. 2 is a front view showing the medium conveying device according to the embodiment of the present disclosure.
Figure 3:
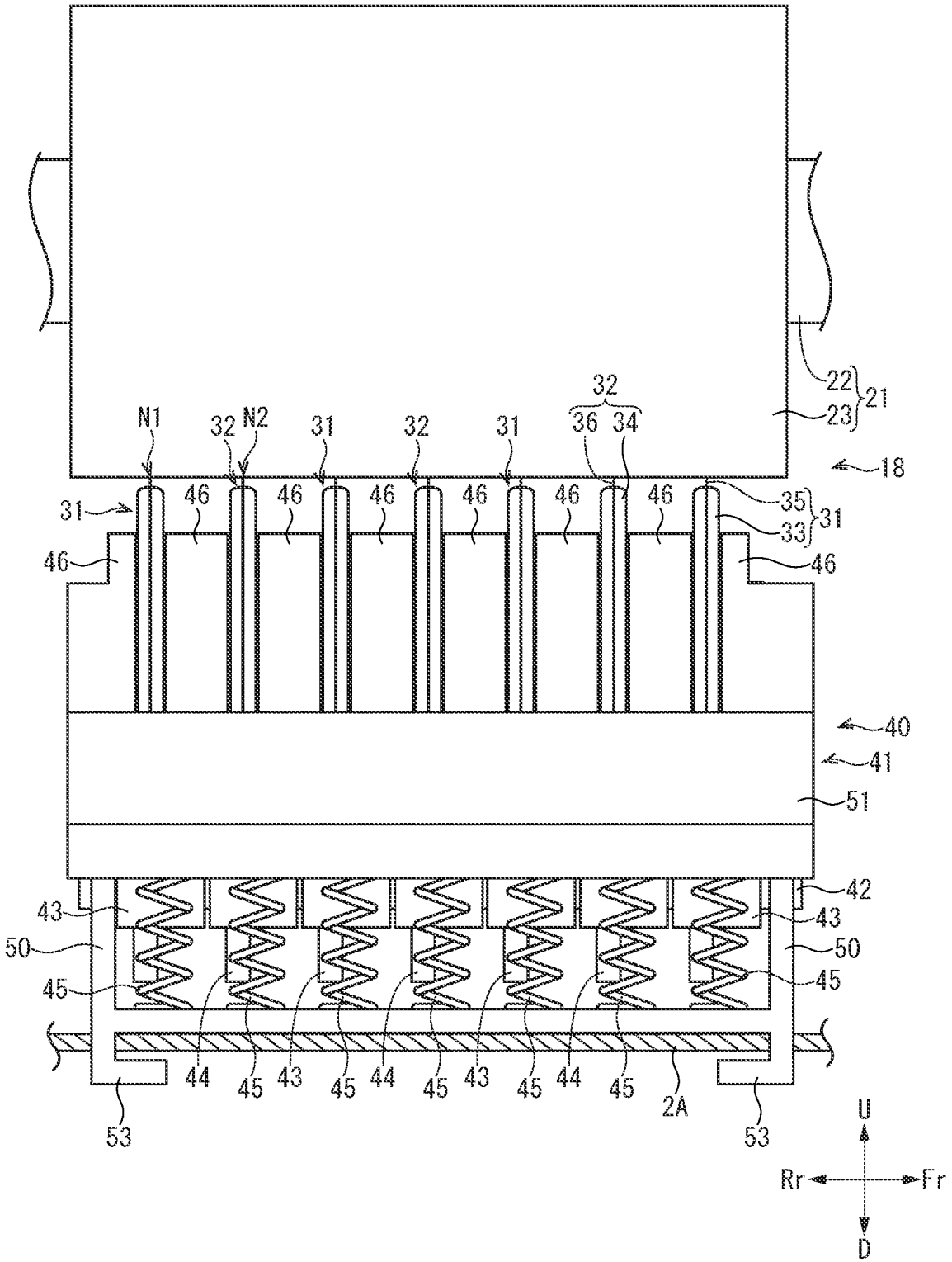
FIG. 3 is a left side view showing the medium conveying device according to the embodiment of the present disclosure.
Figure 4:
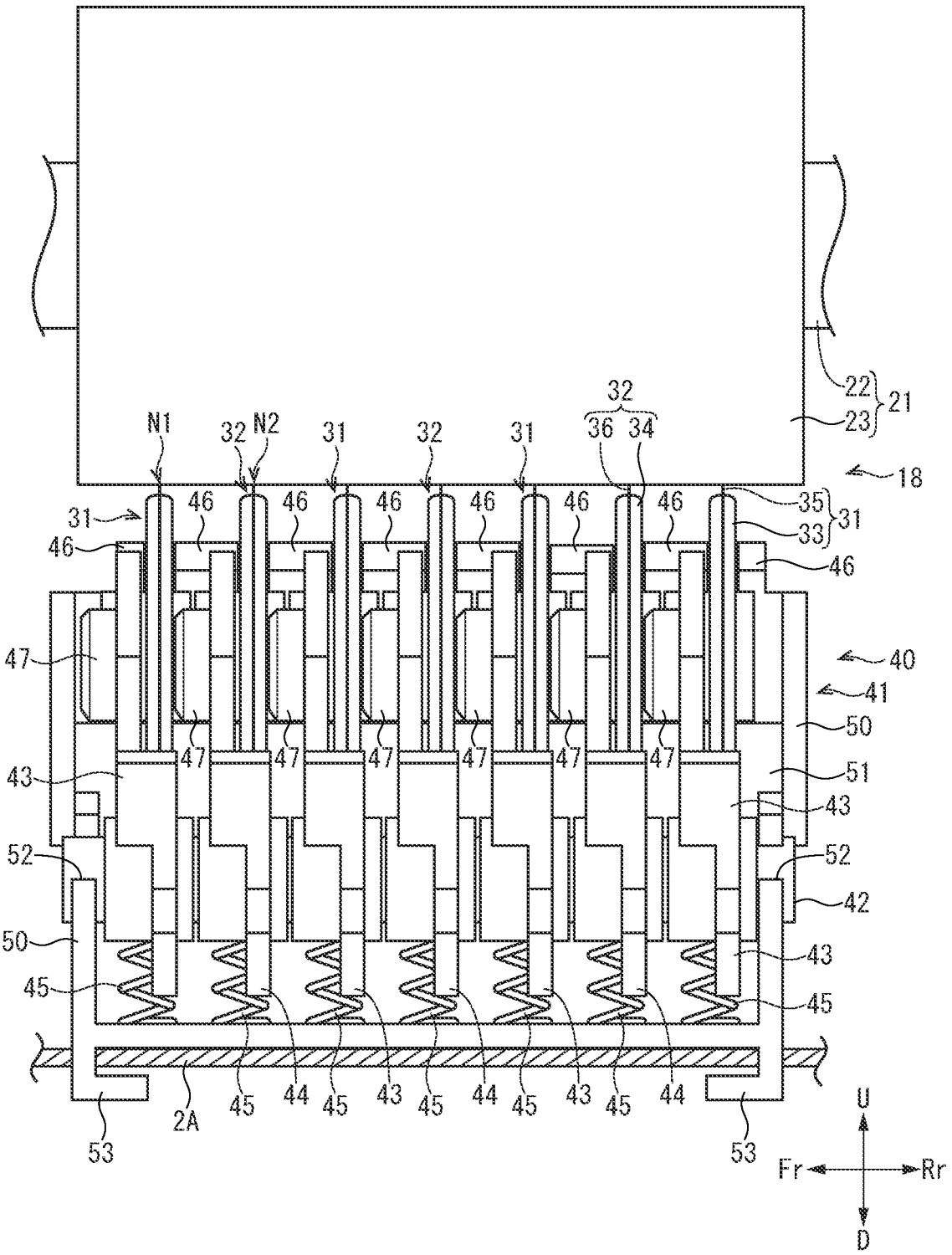
FIG. 4 is a right side view showing the medium conveying device according to the embodiment of the present disclosure.
Figure 5:
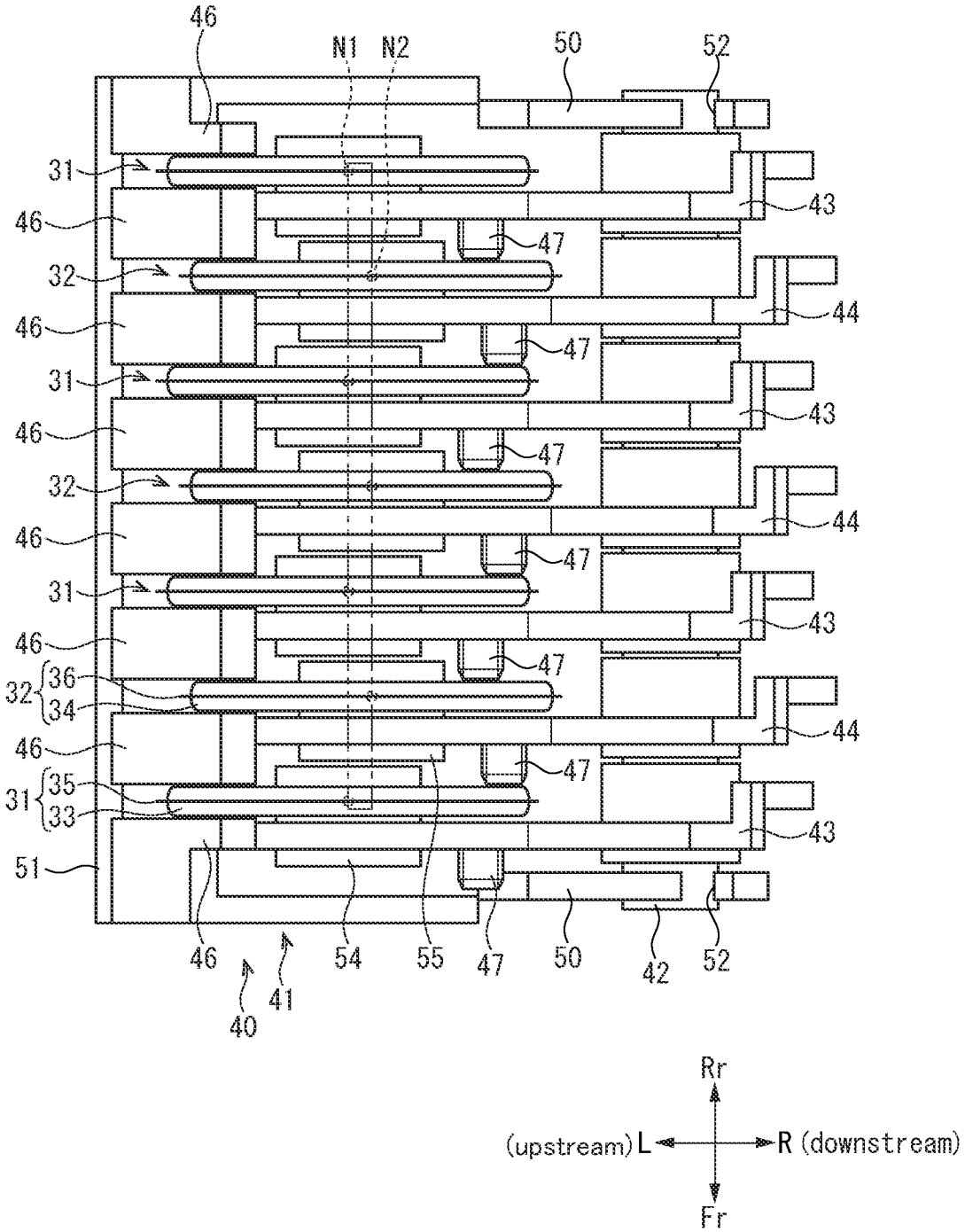
FIG. 5 is a plan view showing a driven roller and the others in the medium conveying device according to the embodiment of the present disclosure.

[Medium Conveying Device] With reference to FIG. 2 to FIG. 5, the medium conveying device 18 will be described. FIG. 2 is a front view showing the medium conveying device 18. FIG. 3 is a left side view showing the medium conveying device 18. FIG. 4 is a right side view showing the medium conveying device 18. FIG. 5 is a plan view showing driven rollers 31, 32 and the others of the medium conveying device 18.

The medium conveying device 18 includes a plurality of (for example, four) conveying rollers pairs 20 and a plurality of (for example, four) support parts 40. The conveying rollers pairs 20 and the support parts 40 are arranged in a line with spaces in the front-and-rear-direction (the width direction), and since they have the same structure, one conveying rollers pair 20 and one support part 40 are described in this specification.

<Conveying Rollers Pair> As shown in FIG. 2 to FIG. 4, the conveying rollers pair 20 includes a driving roller 21, a plurality of (for example, four) first driven rollers 31, and a plurality of (for example, three) second driven rollers 32. The driving roller 21 is driven to be rotated around an axis. The first driven rollers 31 and the second driven rollers 32 are driven by the driving roller 21 to be rotated around axes and to convey the sheet S held between the driving roller 21, and the first driven rollers 31 and the second driven rollers 32. Since the four first driven rollers 31 have the same shape and the three driven rollers 32 have the same shape, one first driven roller 31 and one second driven roller 32 will be described below. In the description common to the first and second driven rollers 31 and 32, they are simply referred to as the "driven rollers 31 and 32."

<Driving Roller> The driving roller 21 has a driving shaft 22 extending in the front-and-rear direction (in the width direction perpendicular to the conveyance direction) and a driving body part 23 fixed to the circumferential surface of the driving shaft 22. Both the end portions of the driving shaft 22 are rotatably supported by a frame (not shown) provided inside the housing 2. The driving shaft 22 is connected to a driving source (not shown) such as an electric motor, and is rotated around the axis by a driving force from the driving source. The driving body part 23 is formed of an elastic body made of synthetic rubber, for example.

(Driven Roller) The seven driven rollers 31 and 32 are supported by the support part 40 so as to be rotatable around the axis. The four first driven rollers 31 and the three second driven rollers 32 are alternately provided with approximately equal spaces in the front-and-rear direction (width direction).

The driven rollers 31, 32 have driven body parts 33, 34 formed in an approximately disk shape, and a plurality of protrusions 35, 36 protruding outwards in the radial direction from the outer circumferential surface of the driven body parts 33, 34, and arranged at intervals in the circumferential direction. The driven body parts 33 and 34 are composed of a pair of discs (not shown), and the driven rollers 31, 32 are formed in such a manner that a gear shaped (spur shaped) thin piece (not shown) having a plurality of protrusions 35, 36 is held between the discs. For example, the driven body parts 33 and 34 are made of the same material as the driving body part 23, and the protrusions 35, 36 are made of synthetic resin or the like in a needle-like shape. In FIG. 2 to FIG. 5, the protrusions 35, 36 are simply shown by a single line.

As shown in FIG. 2 and FIG. 5, the first driven rollers 31 are arranged such that the rotational center is shifted in the upstream side of the second driven rollers 32 in the conveyance direction. The first driven rollers 31 (protrusions 35) are in contact with the driving roller 30 to form a first nip area N1. The second driven rollers 32 (protrusions 36) are in contact with the driving roller 30 on the downstream side of the first driven rollers 31 in the conveyance direction to form a second nip area N2. In the common description of the first nip area N1 and the second nip area N2, they are simply referred to as the "nip areas N1, N2." Also, since it is the protrusions 35, 36 that make contact with the driving roller 21 to form the nip areas N1, N2, the nip areas N1, N2 refer to a very narrow contact area close to the approximate point.

<Support Part> As shown in FIG. 2 to FIG. 5, the support part 40 includes a roller holder 41, a swinging shaft 42, a plurality of (for example, four) first swinging arms 43, a plurality of (for example, three) second swinging arms 44, a plurality of (for example, seven) biasing members 45, a plurality of (for example, eight) upstream restriction parts 46, and a plurality of (for example, seven) downstream restriction parts 47. Since the first swinging arms 43 have the same shape, one first swinging arm 43 will be described below. Similarly, one second swinging arm 44, one biasing member 45, one upstream restriction part 46 and one downstream restriction part 47 will be described below. In the explanation common to the first swinging arm 43 and the second swinging arm 44, they are simply referred to as the "swinging arms 43 and 44." In the common description to the upstream restriction part 46 and the downstream restriction part 47, it is simply referred to as the "restriction parts 46, 47."

(Roller Holder, Swinging Shaft) The roller holder 41 has a pair of end surface parts 50 spaced apart in the front-and-rear direction and a side surface part 51 provided between the left end portions of the end surface parts 50, and is formed in a frame shape opened from the upper side to the right side. The roller holder 41 houses the seven driven rollers 31, 32 (the swinging arms 43, 44). On the right side surface of each end surface part 50, a shaft groove 52 inclined leftward and downward from the upper end is cut out (see FIG. 2). The swinging shaft 42 is formed in a round bar shape extending in the front-and-rear direction (width direction), and is rotatably supported in the shaft grooves 52 of the end surface parts 50. At the lower portion of each end surface part 50, a pawl 53 is protruded, which is engaged with the frame 2A of the housing 2. The left side portion of each end surface part 50 is located one step upper than the right side portion, and is separated upward from the frame 2A (see FIG. 2 and FIG. 3). The side surface part 51 is connected to the lower left end portions of the end surface parts 50 (see FIG. 2 and FIG. 3).

(Swinging Arm) As shown in FIG. 4 and FIG. 5, the four first swinging arms 43 and the three second swinging arms 44 are alternately arranged with approximately equal intervals in the front-and-rear direction (width direction). The right end portions of the swinging arms 43, 44 are fixed to the swinging shaft 42 (see also FIG. 2), and the swinging arms 43, 44 are supported by the roller holder 41 so as to be swingable in the upper-and-lower direction through the swinging shaft 42. The first swinging arm 43 extends from the swinging shaft 42 leftward (one side in the conveyance direction), and the first driven rollers 31 are rotatably supported by the extended tip end portion via a first shaft 54 (see FIG. 5). The second swinging arm 44 extends leftward from the swinging shaft 42, and the second driven rollers 32 are rotatably supported by the extended tip end portion via a second shaft 55 (see FIG. 5). When the first shaft 54 and the second shaft 55 are described together, they will be referred to as the "support shafts 54, 55."

The driven rollers 31, 32 are arranged so as to face the rear side surfaces of the swinging arms 43, 44, and are supported by the support shafts 54, 55 in a cantilevered manner. The first swinging arm 43 (the axial distance from the swinging shaft 42 to the first shaft 54) is longer than the second swinging arm 44 (the axial distance from the swinging shaft 42 to the second shaft 55) (see FIG. 5). That is, the first shaft 54 is located on the upstream of the second shaft 55 in the conveyance direction.

(Biasing Member) As shown in FIG. 2 to FIG. 4, the biasing members 45 are, for example, a compression coil spring, and are installed between the right bottom plate of the roller holder 41 and the swinging arms 43, 44. The biasing members 45 bias the swinging arms 43, 44 toward the driving roller 21.

(Upstream Restriction Part) As shown in FIG. 2 to FIG. 5, the upstream restriction parts 46 are provided in the roller holder 41. Specifically, the upstream restriction parts 46 extend upward from the upper portion of the side surface part 51 so as to curve rightward. The upstream restriction part 46 is formed in a curved arm shape with approximately the same curvature as the driven rollers 31, 32. The six upstream restriction parts 46, except for the two upstream restriction parts 46 located at both ends in the front-and-rear direction, are arranged between adjacent driven rollers 31, 32 on the upstream side of the rotational centers of the driven rollers 31, 32 in the conveyance direction. The six upstream restriction parts 46 face the side surfaces of the adjacent driven body parts 33, 34 with a small gap. The two upstream restriction parts 46 located at both ends in the front-and-rear direction face the side surfaces of the driven body parts 33 of the two first driven rollers 31 located at both ends in the front-and-rear direction with small gaps. The upstream restriction parts 46 are provided in a range from a position intersecting the horizontal line H passing through the rotational centers (supporting shafts 54 and 55) of the driven rollers 31, 32 to a position slightly below (upstream) the apexes of the driven rollers 31, 32 (see FIG. 2).

(Downstream Restriction Part) The downstream restriction parts 47 are provided on the swinging arms 43, 44. Specifically, the downstream restriction parts 47 protrude forward from the front side surfaces of the swinging arms 43, 44. The downstream restriction parts 47 are formed in a curved arm shape with approximately the same curvature as the driven rollers 31, 32. The six downstream restriction parts 47, except for the downstream restriction part 47 located at the frontmost position, are arranged between adjacent driven rollers 31, 32 on the downstream side of the rotational centers of the driven rollers 31, 32 in the conveyance direction. The downstream restriction parts 47 faces the rear side surfaces of the adjacent driven body parts 33, 34 with a small gap. The downstream restriction parts 47 are provided at a position intersecting the horizontal line H passing through the rotational centers (supporting shafts 54, 55) of the driven rollers 31, 32 (see FIG. 2). The downstream restriction parts 47 are formed shorter in the upper-and-lower direction (circumferential direction) than the upstream restriction parts 46. The downstream restriction part 47 provided on the first swinging arm 43 located at the frontmost position faces (not in contact with) the front end surface part 50. Further, although there is no downstream restriction part 47 facing the first driven roller 31 located at the rearmost position, the downstream restriction part 47 may be provided on the rear end surface part 50 (its inner surface) so as to face the first driven roller 31 (not shown).

[Operation of Medium Conveying Device] Next, the operation of the medium conveying device 18 will be described.

When the sheet P is not being conveyed, the swinging arms 43, 44 are biased by the biasing members 45 and swung upward, and the protrusions 35, 36 of the driven rollers 31, 32 come into contact with the driving roller 21 (the driving body part 23) at a prescribed pressure (see FIG. 2). When the driving roller 21 is driven by the drive source to be rotated, the driven rollers 31, 32 are driven to be rotated while contacting with the driving body part 23.

Next, when the sheet P is being conveyed, the swinging arms 43, 44 are swung downward by the sheet P conveyed between the driving roller 21 and the driven rollers 31, 32, and the driven rollers 31, 32 are separated from the driving roller 21. The protrusions 35, 36 come into contact with the surface (the printed surface) of the sheet P, and the driving body part 23 comes into contact with the back surface of the sheet P. Thus, since only the protrusions 35, 36 come into contact with the surface of the sheet P, the ink on the sheet P is prevented from adhering to the driven rollers 31, 32 (the driven body parts 33, 34). In addition, since the driven rollers 31, 32 are provided at intervals in the axial direction, it is possible to properly convey the sheet P of various sizes (widths).

Incidentally, for example, the driven rollers 31, 32 may receive a reaction force from the sheet P being conveyed and tilt slightly with respect to the proper conveyance direction. Then, the sheet P may be conveyed obliquely along the tilt of the driven rollers 31, 32, and there is a possibility that the sheet P is jammed in the second conveyance path 7. In addition, when the obliquely conveyed sheet P is discharged onto the sheet discharge tray 4, the sheet P cannot be stacked in an aligned state and may be dropped from the sheet discharge tray 4.

In response to the above problem, in the medium conveying device 18 according to the present embodiment, the upstream restriction parts 46 and the downstream restriction parts 47 are arranged between the adjacent driven rollers 31, 32 on the upstream and downstream sides in the conveyance direction across the rotational centers of the driven rollers 31, 32 (see FIG. 2 to FIG. 5). When the driven rollers 31, 32 begin to tilt with respect to the proper conveyance direction, the side surfaces of the driven rollers 31, 32 interfere with the restriction parts 46, 47 and further tilting is prevented. Specifically, for example, when the driven rollers 31, 32 begin to rotate (tilt) in the clockwise direction in a plan view (see FIG. 5), the rear side surfaces of the driven body parts 33, 34 come into contact with the upstream restriction parts 46 on the upstream side of the support shafts 54, 55, and the front side surfaces of the driven body parts 33, 34 come into contact with the downstream restriction parts 47 on the downstream side of the support shafts 54, 55. In this way, the upstream restriction parts 46 and the downstream restriction parts 47 come into contact with the side surfaces of the driven rollers 31, 32 (the driven body parts 33, 34) to restrict the tilting of the driven rollers 31, 32 with respect to the (proper) conveyance direction. This restricts the excessive tilting of the driven rollers 31, 32, so that the sheet P can be conveyed along the proper conveyance direction.

Incidentally, in the medium conveying device 18 according to the present embodiment, the first driven rollers 31 and the second driven rollers 32 come into contact with the driving roller 21 while shifted in the conveyance direction (see FIG. 2 and FIG. 5), but considering a case where all the driven rollers 31 and 32 (the nip areas N1, N2) are arranged in a row horizontally. In this case, since the leading edge of the conveyed sheet P collides with all the driven rollers 31, 32 (the nip areas N1, N2), the sheet P may receive a large resistance force. If the image is being formed on the rear portion of the sheet P when the leading edge of the sheet P enters the nip areas N1, N2, the impact upon entering the nip areas N1, N2 may be transmitted to the rear portion of the sheet P, causing color shift or the like on the image.

In response to the above problem, in the medium conveying device 18 according to the present embodiment, the second driven rollers 32 are in contact with the driving roller 21 on the downstream side of the first driven rollers 31, and the second nip area N2 is formed on the downstream side of the first nip area N1 (see FIG. 2 and FIG. 5). Therefore, the leading edge of the sheet P enters the first nip area N1, passes through the first nip area N1, and then enters the second nip area N2. With this configuration, the resistance force (the impact) that the sheet P receives can be reduced compared with the case where the leading edge of the sheet P collides with all the driven rollers 31 and 32 (the nip areas N1, N2). This softens the impact transmitted from the leading edge of the sheet P to the rear portion, so that the occurrence of color shift or the like can be suppressed when the image is being formed on the rear portion of the sheet P. In addition, since the first nip area N1 and the second nip area N2 are shifted in the conveyance direction and constitute a pseudo surface (see the two-dashed line shown in FIG. 5), the posture of the sheet P held between the nip areas N1, N2 can be stabilized and stable conveyance can be performed.

Now consider the procedure (method) for assembling the driven rollers 31 and 32 into the roller holder 41. If both the restriction parts 46, 47 may be provided in the roller holder 41, after all the driven rollers 31, 32 are arranged between the adjacent upstream restriction parts 46 and the adjacent downstream restriction parts 47, the driven rollers 31, 32 are attached to the swinging arms 43, 44, the swinging shaft 42 is passed through the swinging arms 43, 44, and then the swinging shaft 42 is fitted into the pair of shaft grooves 52 of the roller holder 41. This procedure (method) makes it very difficult to assemble the driven rollers 31, 32 into the roller holder 41, and requires long time.

In response to the above problem, in the medium conveying device 18 according to the present embodiment, the upstream restriction parts 46 are provided in the roller holder 41, and the downstream restriction parts 47 are provided in the swinging arms 43, 44 (see FIG. 2 to FIG. 5). According to this configuration, as an example of the procedure (method) for assembling the driven rollers 31, 32 into the roller holder 41, by attaching all the driven rollers 31, 32 to the swinging arms 43, 44 and then attaching the swinging arms 43, 44 to the swinging shaft 42, all the driven rollers 31, 32 can be set in a state where the tilting is restricted by the downstream restriction parts 47. Then, by fitting the swinging shaft 42 into the pair of shaft grooves 52 of the roller holder 41 while inserting each of the driven roller 31, 32 between the adjacent upstream restriction parts 46, all the driven rollers 31, 32 can be set in the state where the tilting is restricted by the upstream restriction parts 46. Thus, the work of assembling the driven rollers 31, 32 into the roller holder 41 can be facilitated. It is recommended that the first swinging arm 43 and the second swinging arm 44 be colored so as not to mistake the arrangement of the swinging arms 43, 44 having different lengths (not shown).

In the medium conveying device 18 according to the present embodiment, the upstream restriction parts 46 are provided in the roller holder 41 and the downstream restriction parts 47 are provided in the swinging arms 43, 44, but the present disclosure is not limited to these. For example, on the contrary, the upstream restriction parts 46 may be provided in the swinging arms 43, 44 and the downstream restriction parts 47 may be provided in the roller holder 41 (not shown). Both the restriction parts 46, 47 may be provided in the swinging arms 43, 44 (not shown). In addition, although the assembly work becomes difficult, both the restriction parts 46, 47 may be provided in the roller holder 41 (not shown). In addition, although the downstream restriction parts 47 protrude from the front side surface of the swinging arms 43, 44, it is not limited to this. The downstream restriction parts 47 may protrude from the rear side surface of the swinging arms 43, 44 (not shown).

Also, in the medium conveying device 18 according to the present embodiment, the upstream restriction parts 46 and the downstream restriction parts 47 face each other on both sides of the conveyance direction across the rotational centers of the driven rollers 31, 32 at positions intersecting the horizontal line H, but the present disclosure is not limited to this. The upstream restriction parts 46 and the downstream restriction parts 47 may be arranged on both sides of the conveyance direction across the rotational centers of the driven rollers 31 and 32, and may not necessarily face each other at the positions intersecting the horizontal line H (not shown). In addition, at least one of the upstream restriction parts 46 and the downstream restriction parts 47 may be provided. For example, two upstream restriction parts 46 and one downstream restriction part 47 may be provided in the circumferential direction at approximately 120 degrees (not shown). In addition, for example, the two upstream restriction parts 46 and the two downstream restriction parts 47 may be provided in the circumferential direction at approximately 90 degrees (not shown). In addition, although the upstream restriction parts 46 are formed longer in the upper-and-lower direction (the circumferential direction) than the downstream restriction parts 47, the upstream restriction parts 46 may be formed shorter in the circumferential direction than the downstream restriction parts 47 or may be formed to the same length as the downstream restriction parts 47 (not shown).

In addition, according to the medium conveying device 18 according to the present embodiment, the seven driven rollers 31, 32 are provided, but the present disclosure is not limited to this. The two or more driven rollers 31, 32 may be provided. Although the first driven rollers 31 are in contact with the driving roller 21 on the upstream side of the second driven rollers 32, it is not limited to this. The second driven rollers 32 may be in contact with the driving roller 21 on the upstream side of the first driven rollers 31 (not shown). In addition, although the impact reduction effect when the sheet P enters the nip areas N1, N2 is eliminated, all the driven rollers 31, 32 (the nip areas N1, N2) may be arranged in a row horizontally (not shown). In addition, the driven rollers 31, 32 are formed in a spur shape with the plurality of protrusions 35 and 36, but the present disclosure is not limited to this. They may be formed in a disk shape omitting the plurality of protrusions 35, 36 (not shown). That is, the driven rollers 31 and 32 may consist of only the driven body parts 33, 34 (not shown).

In the image forming apparatus 1 described above, the recording head 14 ejects the ink droplets from the nozzles, but the droplets ejected from the nozzles are not limited to the ink droplets, and may be water, liquid adhesive or liquid synthetic resin, for example.

The image forming apparatus 1 described above is a color printer, but it is not limited to this, and may be a monochrome printer, a copying machine, a facsimile machine, or the like. In addition, the image forming method of the image forming apparatus 1 is not limited to the inkjet type, but may be an electrophotographic type.

The description of the above embodiment shows one aspect of the media conveyance device and the image forming device according to the present disclosure, and the technical scope of the present disclosure is not limited to the above embodiment. The disclosure may be variously modified, replaced, or modified to the extent that it does not deviate from the purport of the technical idea, and the scope of the patent claims includes all of the implementations that may be included within the technical idea.

The invention claimed is:

1. A medium conveying apparatus comprising:

a driving roller driven to be rotated around an axis;

a plurality of driven rollers provided at intervals, driven by the driving roller to be rotated around an axis and to convey a medium held between the driving roller and the driven rollers;

a support part which supports the driven rollers so as to be rotatable around the axis;

a plurality of upstream restriction parts provided in the support part between the adjacent driven rollers; and a plurality of downstream restriction parts provided in the support part between the adjacent driven rollers, the support part includes:

a roller holder which houses the driven rollers;

a plurality of swinging arms which are swingably supported by the roller holder via a swinging shaft and rotatably supports the driven rollers on a tip side extended from the swinging shaft; and a plurality of biasing members which bias the swinging arms to the driving roller, and one of the upstream restriction parts and the downstream restriction parts are provided in the roller holder, and the other of the upstream restriction parts and the downstream restriction parts are provided in the swinging arms, wherein the upstream restriction parts and the downstream restriction parts are arranged on an upstream side and a downstream side in a conveyance direction of the medium across a rotational center of the driven rollers respectively, and when the driven rollers are tilted with respect to the conveyance direction, at least one of the upstream restriction parts and the downstream restriction parts comes into contact with side surfaces of the driven rollers to restrict tilting of the driven rollers.

2. The medium conveying apparatus according to claim 1, wherein the driven roller includes:

at least one first driven roller which comes into contact with the driving roller to form a first nip area; and at least one second driven roller which comes into contact with the driving roller on a downstream side of the first driven roller in the conveyance direction to form a second nip area.

3. The medium conveying apparatus according to claim 2, wherein each of the first driven roller and the second driven roller is a spur roller formed by holding a spur-shaped thin piece having a plurality of protrusions between a pair of discs.

4. The medium conveying apparatus according to claim 2, wherein the first and second driven rollers are alternately arranged at equal intervals.

5. The medium conveying apparatus according to claim 1, wherein when the driven rollers are not tilted with respect to the conveyance direction, the upstream restriction parts and the downstream restriction parts do not come into contact with the side surfaces of the driven rollers.

6. An image forming apparatus comprising the medium conveying apparatus according to claim 1.

* * * * *